United States Patent [19]

Cox, Jr.

[11] 4,081,957

[45] Apr. 4, 1978

[54] PREMIXED COMBUSTOR

[75] Inventor: George Benjamin Cox, Jr., Tequesta, Fla.

[73] Assignee: United Technologies Corporation, Hartford, Conn.

[21] Appl. No.: 682,945

[22] Filed: May 3, 1976

[51] Int. Cl.[2] ..... F02C 7/22

[52] U.S. Cl. ..... 60/39.36; 60/39.71

[58] Field of Search ..... 60/39.37, 39.74 R, 39.71, 60/39.36; 415/207, 211

[56] References Cited

U.S. PATENT DOCUMENTS

| | | | |
|---|---|---|---|
| 2,567,079 | 9/1951 | Owner et al. | 60/39.37 |
| 2,920,449 | 1/1960 | Johnson | 60/39.74 R |
| 3,238,718 | 3/1966 | Hill | 60/39.37 |
| 3,283,502 | 11/1966 | Lefebvre | 60/39.71 |
| 3,584,791 | 6/1971 | Stratton et al. | 60/39.74 R |

FOREIGN PATENT DOCUMENTS

| | | | |
|---|---|---|---|
| 1,007,743 | 5/1952 | France | 60/39.37 |
| 619,232 | 3/1949 | United Kingdom | 60/39.37 |
| 615,680 | 1/1949 | United Kingdom | 60/39.37 |

*Primary Examiner*—Robert E. Garrett
*Attorney, Agent, or Firm*—Robert C. Walker

[57] ABSTRACT

A combustion system for a gas turbine engine is disclosed. Fluid transfer and premixing techniques are developed. The combustion system is specifically adapted, in one embodiment, to an engine having a centrifugal or an axial/centrifugal compressor including a pipe diffuser at the downstream end thereof. Flow transfer tubes are shown between the pipe diffuser and a radial inflow combustor.

5 Claims, 4 Drawing Figures

FIG. 1
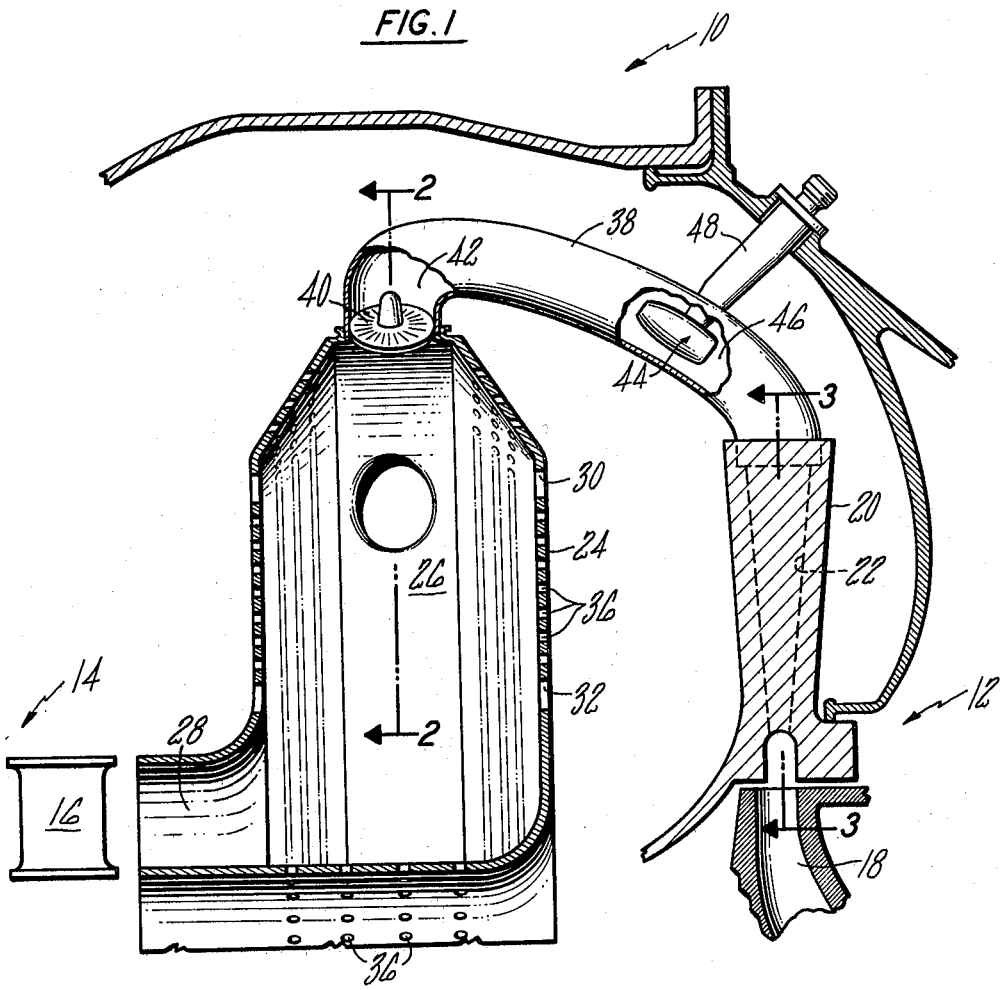
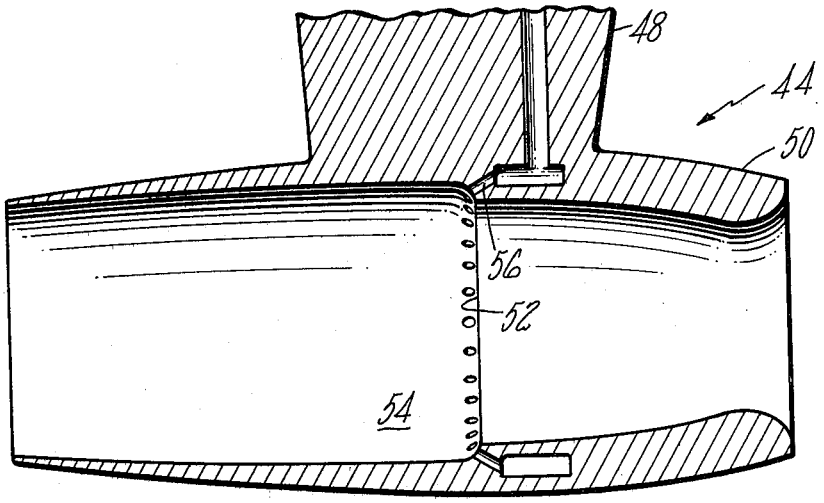
FIG. 4

PREMIXED COMBUSTOR

BACKGROUND OF THE INVENTION

1. Field of the Invention

This invention relates to gas turbine engines and more specifically to centrifugal or axial/centrifugal engines having a pipe diffuser at the downstream end of the compression section.

2. Description of the Prior Art

Increasingly restrictive environmental pollution standards and dramatically increased fuel costs are causing engine manufacturers to devote substantial financial and personnel resources to the search for more efficient and cleaner combustion systems. Prior art techniques are no longer adequate and must be replaced in future engines with apparatus embodying technically superior systems.

Of the prior art systems known, U.S. Pat. Nos. 3,088,279 to Diedrich entitled "Radial Flow Gas Turbine Power Plant" and 3,238,718 to Hill entitled "Gas Turbine Engine" are considered to be illustrative of prior employed techniques. Both systems are suited to centrifugal or axial/centrifugal compression apparatus and employ radial inflow combustion technology.

In Diedrich a centrifugal impellor discharges medium gases radially into a diffuser. Radial vanes and axial vanes within the diffuser direct the medium gases to an annular chamber from which the gases are flowable into the combustor. High pressure, high velocity gases which discharge from the impellor during operation of the engine are partially decelerated within the diffuser and are further decelerated within the annular chamber after being dumped from the diffuser. Gases within the annular chamber remain at high pressure but have a substantially reduced velocity. Hill is a similar illustration of prior art techniques which diffuse the medium gases to a lower velocity. One feature of note in Hill is the pipes which carry the medium gases from the centrifugal impellor to the annular plenum chamber in which the combustors are disposed.

To the detriment of engine performance, a substantial portion of the velocity pressure head of the medium gases discharged from the compressors of the prior art engines is dissipated during the diffusion process.

SUMMARY OF THE INVENTION

A primary object of the present invention is to improve the overall performance of a gas turbine engine. A structure making effective use of the velocity pressure head of the medium gases discharging from the diffuser section of the engine is sought. An improvement in combustion efficiency and a reduction in the amount of environmental pollutants discharged by an operating engine are concurrent goals.

According to the present invention a plurality of flow transfer tubes within a gas turbine engine having a centrifugal compression stage are disposed between a pipe diffuser and a radial inflow combustor to preserve the velocity pressure head of a portion of the high pressure gases discharging from the diffuser.

In accordance with one embodiment of the invention, fuel and air are premixed within the flow transfer tubes and the resultant mixture is discharged at high velocity into the combustion chamber.

A primary feature of the present invention is the flow transfer tubes through which a portion of the medium gases are flowable from the diffusion passages of the pipe diffuser to the combustion chamber. Said portion of the working medium gases flowing through the transfer tubes is discharged directly into the combustion chamber. In one embodiment, a fuel atomizing injector is disposed within each tube. The tubes in another embodiment are obliquely oriented with respect to the radial chamber so as to impart a circumferential velocity component to the medium gases flowing into the chamber.

A reduction in the amount of environmental pollutants discharged from the combustion chamber is one advantage of apparatus incorporating the described premixing techniques. The velocity pressure head of the medium gases discharging from the diffuser is conserved within the flow transfer tubes and is available to aid in the atomization and mixing of the fuel. Flow turning losses within the control tubes are avoided and transverse mixing within the combustion chamber is promoted by orienting the tubes obliquely to the radial chamber. Atomization improves the uniformity of combustion within the chamber.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a simplified cross section view taken through the combustion section of a gas turbine engine having a centrifugal compression stage;

FIG. 4 is an enlarged view of the fuel atomizing injector shown in FIG. 1.

DESCRIPTION OF THE PREFERRED EMBODIMENT

Figure 2:
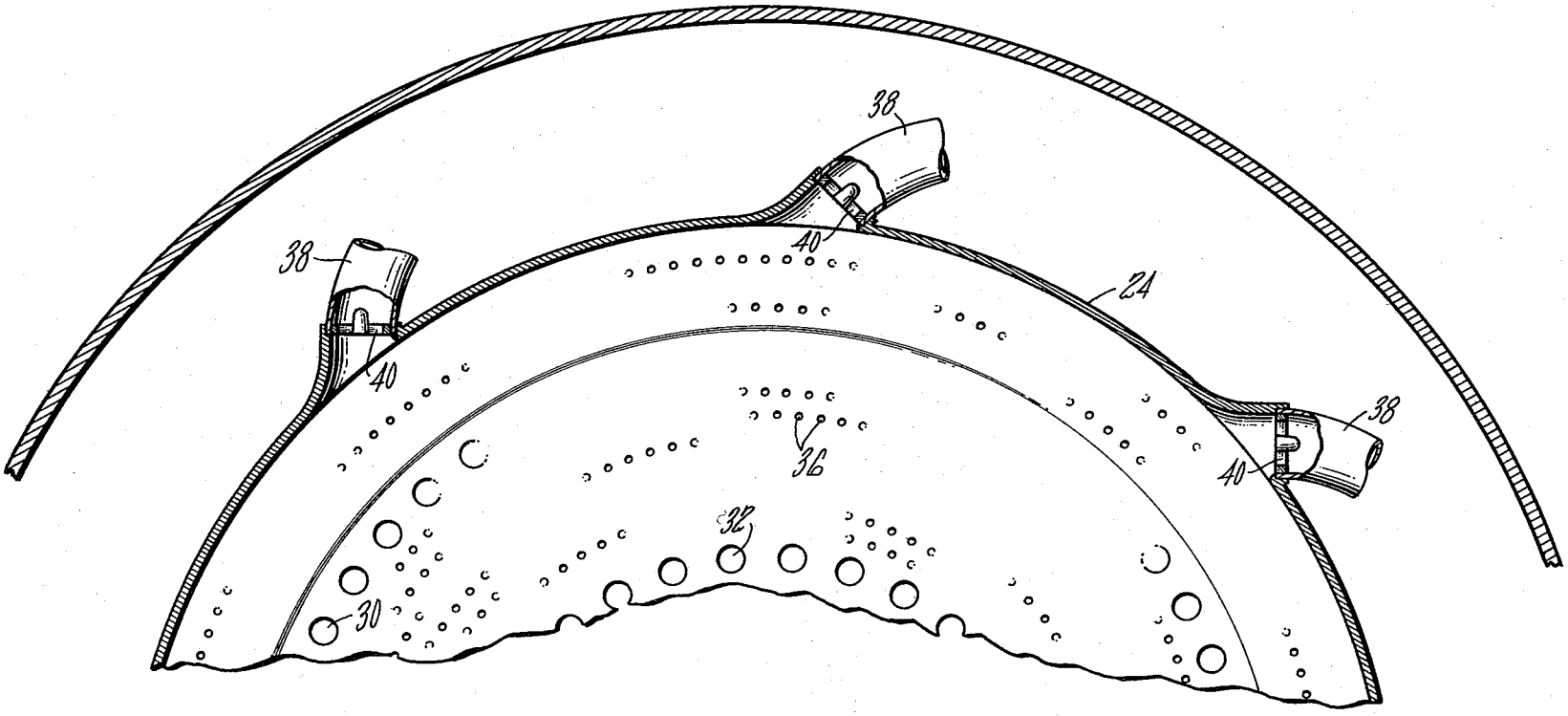
FIG. 2 is a sectional view taken along the line 2—2 as shown in FIG. 1 illustrating the oblique orientation of the flow transfer tubes in one embodiment of the present invention.

The combustion section 10 of a gas turbine engine is shown in FIG. 1 between the compression section 12 and the turbine section 14 of an engine. A row of stator vanes as represented by the single vane 16 is disposed across the inlet to the turbine section. The compression section is of the centrifugal or axial/centrifugal type and has a centrifugal impellor 18. A stationary pipe diffuser 20 having a plurality of diffusion passages 22 as represented by the single passage shown is positioned radially outward of the impellor.

Within the combustion section 10 is a combustion chamber or combustor 24. The chamber shown is of the radial inflow type having a first annular region 26 through which the working medium gases are flowable in the radially inward direction and a second annular region 28 through which the working medium gases are flowable in the axial direction toward the stator vanes 16 of the turbine section 14. The first annular region has a plurality of combustion holes 30 and a plurality of dilution holes 32 disposed in the walls 34 thereof. The walls are further penetrated by a multiplicity of cooling holes 36.

A flow transfer tube 38 is disposed between the pipe diffuser 20 and the combustion chamber 24. The transfer tube places one of the diffusion passages 22 in direct communication with the first annular region 26 of the chamber. In the embodiment shown a flow swirler 40 is positioned at the downstream end 42 of the transfer tube to impart a high velocity swirl to the gases discharging from the tube. Also in the FIG. 1 embodiment, a fuel atomizing injector 44 is incorporated within the upstream region 46 of the transfer tube. As is viewable in FIG. 2, a plurality of flow transfer tubes 38 are employable within the combustion system. In this embodiment it may be advantageous to orient the transfer tubes obliquely, as is shown, to the radial chamber thereby imparting a circumferential velocity component to the gases within the first annular region of the chamber.

Figure 3:
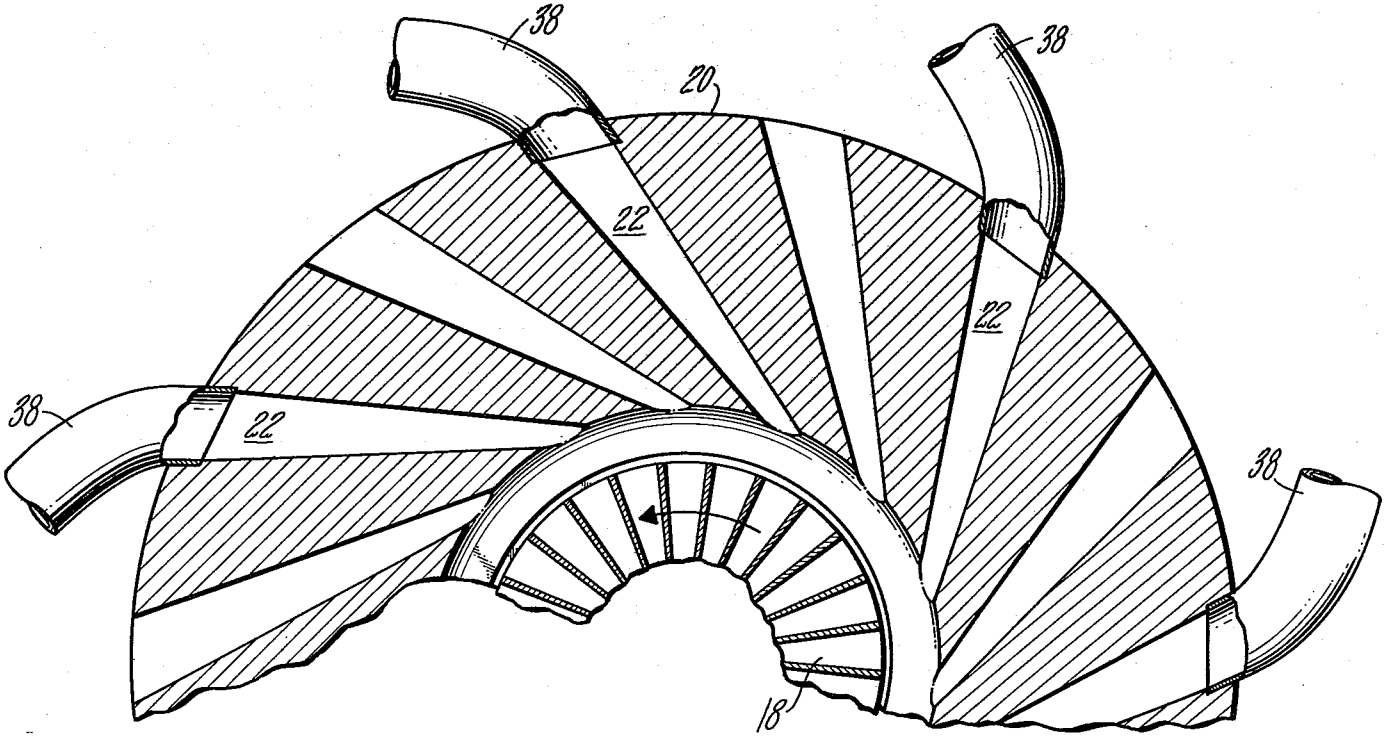
FIG. 3 is a sectional view taken along the line 3—3 as shown in FIG. 1 illustrating the cooperative relationship of the flow transfer tubes and the pipe diffuser.

Referring to FIG. 3 it is apparent that only a portion of the high pressure gases flowing through the pipe diffuser 20 are captured within the flow transfer tubes 38. The transfer tube is aligned with the direction of discharge of the medium gases from the diffuser passage 22 so as to conserve the angular momentum of the discharging gases.

An enlarged view of the fuel atomizing injector 44 is shown in FIG. 4. The injector comprises a support strut 48 and an annular shroud 50. An aerodynamic lip 52 extends circumferentially about the interior of the shroud forming a sheltered region 54 downstream of the lip. Fuel passages 56 communicatively join the sheltered region to the interior of the engine fuel manifold which is not shown.

Conservation of the velocity pressure head of a portion of the medium gases discharging from the diffuser enables operation of the combustor at a higher internal pressure while maintaining an adequate mixing capability within the chamber. High velocity gases are required at the entrance to the chamber to establish a stable flame holding zone of recirculation. These high velocities within prior chambers were established by taking a substantial pressure drop at the entrance to the chamber. The high velocities are attainable in the combustor 24 of the present embodiments through conservation of the velocity pressure head in the transfer tubes 38. Consequently, a lower pressure drop across the swirlers 40 is employable while maintaining comparable internal flow characteristics within the combustor.

In one embodiment the tubes 38 are oriented obliquely to the radial chamber as is shown in FIG. 2. The gases discharging from the tubes of that embodiment have a circumferential velocity component as they enter the first annular region 26 of the chamber. The circumferential velocity component of the gases promotes transverse mixing within the region 26. Transverse mixing encourages more rapid and complete combustion with a resulting decrease in the amount of environmental pollutants discharged from the chamber.

As is viewable in FIG. 1, a fuel atomizing injector 44 may be disposed within the transfer tube 38. The combustion system employing this technique is referred to within the art as a "fuel premixing" combustion system. Fuel is stripped from the injector by the high velocity gases of the tube which flow therethrough; mixes with the air within the tube; and is dumped through the flameholding swirler into the first annular region 26. The premixed fuel and air burns more rapidly and completely than does the fuel in the more conventional pressure atomizing injection systems.

The transfer tube concept is particularly advantageous when used with the above described premixing techniques. The air velocities in the injector region are substantially higher than in systems not preserving the exit velocity of the gases from the diffuser. This advantage is more fully understood when viewing FIG. 4. Fuel is flowed through the passages 56 to the sheltered region 54 immediately downstream of the aerodynamic lip 52. The high velocity gases strip fuel from the region and mix the fuel with the air within a wake downstream of the lip as the high velocity gases expand into the sheltered region 54. The higher the velocity of the gases passing the lip the greater the extent of the mixing.

The fuel atomizing injector 44 is located within the lip 38 at a location remote from the swirler 40. Positioning the injector further from the swirler increases the residence time of the fuel air mixture within the tube and, resultantly, increases the extent of premixing.

Although the flow transfer technique claimed herein may be employed independently of fuel premixing systems, the combination of flow transfer and premixing is thought to have the most beneficial effects on engine performance and pollution control.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the United States is:

1. A combustion system for a gas turbine engine of the type having a pipe diffuser including incorporated therein an outwardly oriented diffusion passage, the system comprising:

a radial inflow, annular combustor having a first annular region through which the working medium gases are flowable in the radially inward direction, a flow swirler positioned at the outer circumference of the first annular region and through which a portion of the medium gases are flowable into the combustor, and a second annular region, extending axially rearward from the first annular region, through which working medium gases are flowable; and a flow transfer tube which communicatively joins said outwardly oriented diffusion passage to said flow swirler and through which a portion of the working medium gases is flowable to the combustor.

2. The invention according to claim 1 which further includes, fuel premixing means disposed within said transfer tube at a remote location from said swirler so as to encourage substantial premixing of the fuel with the medium gases flowing through said transfer tube.

3. The invention according to claim 2 wherein said fuel premixing means comprises:

a shroud having an essentially cylindrical geometry and including an aerodynamic lip circumferentially extending about the inner wall thereof forming a sheltered region downstream of the lip; and fuel passages disposed within said shroud, fuel being flowable to the sheltered region for atomization with air flowing through said shroud during operation of the engine.

4. The invention according to claim 3 wherein said transfer tube is oriented obliquely to said radial combustor so as to promote transverse mixing of the medium discharged from said tube during operation of the engine with the medium contained within the combustor.

5. The invention according to claim 4 wherein said transfer tube is aligned with the direction of discharge of medium gases from said diffusion passage so as to conserve the angular momentum of the discharging gases.

* * * * *